US006179674B1

(12) United States Patent
Eichinger et al.

(10) Patent No.: US 6,179,674 B1
(45) Date of Patent: Jan. 30, 2001

(54) MOUNTING SYSTEM FOR A MARINE PROPULSION DEVICE

(75) Inventors: Charles H. Eichinger, Oshkosh; Richard A. Davis, Mequon, both of WI (US)

(73) Assignee: Brunswick Corporation, Lake Forest, IL (US)

( * ) Notice: Under 35 U.S.C. 154(b), the term of this patent shall be extended for 0 days.

(21) Appl. No.: 09/510,768

(22) Filed: Feb. 23, 2000

(51) Int. Cl.[7] ..... B63H 23/36
(52) U.S. Cl. ..... 440/112
(58) Field of Search ..... 440/38, 111, 112

(56) References Cited

U.S. PATENT DOCUMENTS

| | | | | |
|---|---|---|---|---|
| 3,948,206 | | 4/1976 | Tyler | 115/70 |
| 4,040,378 | * | 8/1977 | Blanchard | 440/112 |
| 4,193,367 | | 3/1980 | Benincasa et al. | 114/68 |
| 5,282,444 | | 2/1994 | Ito et al. | 123/192 |
| 5,364,295 | * | 11/1994 | Rodskier | 440/112 |
| 5,720,638 | | 2/1998 | Hale | 440/83 |
| 5,938,490 | | 8/1999 | Rodler | 440/41 |

* cited by examiner

*Primary Examiner*—Stephen Avila
(74) *Attorney, Agent, or Firm*—William D. Lanyi

(57) ABSTRACT

A support structure for a marine propulsion system utilizes a compressible member that is supported between two surfaces in a manner that prevents the compressible member from being significantly compressed. The compressible member is generally U-shaped and has two arms that have distal ends which extend away from each other to provide an appropriate sealing function without the need for significant compression of the compression member.

17 Claims, 6 Drawing Sheets

MOUNTING SYSTEM FOR A MARINE PROPULSION DEVICE

BACKGROUND OF THE INVENTION

1. Field of the Invention

The present invention is generally related to a mounting system for a marine propulsion device and, more particularly, to a support system for a jet pump which both isolates the propulsion device from the marine vessel and prevents water leakage into the marine vessel.

2. Description of the Prior Art

Many different types of marine vessels are well known to those skilled in the art. One particular type of marine propulsion device includes a jet pump that expels water in order to provide thrust for a marine vessel, such as a jet boat or personal watercraft.

U.S. Pat. No. 3,948,206, which issued to Tyler on Apr. 6, 1976, describes a jet powered watercraft. The jet powered watercraft has a motorcyclelike configuration. Longitudinally aligned front and rear skis are located in spaced relation below a hull and operate to hydrodynamically lift the watercraft to a cruise position by relative water flow upon the undersides of the skis. The rear ski and a jet pump are secured as an integral unit to an engine. The rear ski includes an opening through which water passes to the jet pump, and further includes channels on either side of the opening to collect and carry away entrained air. The engine is located in the hull and is cooled by water supplied by the jet pump which it drives. The front ski is rotatable for steering and is resiliently extensible for stability in turning. The center of buoyancy of the watercraft is above its center of gravity so that the craft is self-righting. The exhaust and cooling systems are arranged to eliminate flooding despite location of portions of the engine below water when the craft is at rest. The jet pump discharge nozzle is completely out of the water in the cruise position of the craft for maximum thrust. In FIG. 6 of the Tyler patent, a mounting means is identified by reference numeral 42 which shows an elastomeric member disposed between a portion of the hull and the marine propulsion device.

U.S. Pat. No. 4,193,367, which issued to Benincasa et al on Mar. 18, 1980, described a boat that is designed to withstand the force of underwater explosions. The vessel comprises a hull which consists of a single skin bottom plating comprising a plurality of large area membrane members supported by structural members about their outer periphery only and being of low areal density so as to deflect rapidly and substantially in response to the force of the shock wave of an underwater explosion without permanent deformation and whose personnel and machinery compartments are supported from hull structure members, such as bulkheads, solely by shock absorbing mounts.

U.S. Pat. No. 5,720,638, which issued to Hale on Feb. 24, 1998, discloses an engine drive shaft coupler for a personal watercraft. The jet propelled watercraft has a coupling assembly to couple an engine crankshaft to a jet pump impeller shaft. The coupling assembly can accommodate substantial engine crankshaft vibrations, yet effectively isolates the jet pump impeller from transverse movement. The coupling assembly includes an engine crankshaft coupling head, an intermediate coupler, an impeller shaft coupling head, and two elastomeric isolators positioned between each of the coupling heads and the intermediate coupler. The intermediate coupler is supported exclusively by the elastomeric isolators, and is allowed to tilt transversely to the rotational axis of the intermediate coupler to accommodate engine crankshaft displacement. The coupling assembly is practical for personal watercraft because, although elastomeric isolators wear or shred quickly in the presence of transverse misalignment, elastomeric isolators provide significant durability in the presence of a reasonably amount of angular displacement. The coupling assembly allows the engine to be softly mounted to the hull of the watercraft, and therefore significantly reduces engine noises resonating from the watercraft hull.

U.S. Pat. No. 5,282,444, which issued to Ito et al on Feb. 1, 1994, describes a power transmitting system of a small boat. An improved arrangement for connecting an engine output shaft to a propulsion unit input shaft is described. Also provided is an arrangement for balancing an engine within the craft against undesirable operational forces tending to render the craft unstable. The connecting assembly includes a coupling arrangement utilizing elastomeric vibration dampening members. One of the dampening members possesses a high degree of elasticity, while another of the dampening members possesses a low degree of elasticity. A durable, yet efficient vibration dampening coupling arrangement, which is additionally able to act as a universal joint, is thereby achieved. The engine balancing arrangement includes a flywheel which rotates in response to the crankshaft assembly of the engine. The flywheel is weighted, and rotates in a direction opposite to that of the crankshaft assembly, so that a rotational momentum is achieved by the flywheel to offset undesirable rotational forces created by the crankshaft assembly.

U.S. Pat. No. 5,938,490, which issued to Rodler on Aug. 17, 1999, describes a outboard marine propulsion system for a vessel in which an intake duct having an intake orifice positioned for receiving water is described. The intake duct includes a curved flow path directing walls curved continuously to provide a 180 degree turn for the water so as to direct the water flowing in an initial direction to a direction opposite the initial direction. An annular duct contiguous with the intake duct at the end of the intake duct is positioned opposite the intake orifice. The annular duct has walls curved continuously to provide a second substantially 180 degree turn to direct water flowing therethrough through a continuous change in direction of substantially 180 degrees such that the water is flowing in a direction approximate that of its initial direction of the intake orifice and substantially opposite the direction to which it entered the annular duct.

The patents described above are hereby explicitly incorporated by reference in the description of the present invention.

One problem that occurs when a marine propulsion device, such as a jet pump, is supported by a hull of a watercraft, such as a personal watercraft or a jet boat, is that the support mechanism must generally serve two distinctly different purposes. One purpose is to support the marine propulsion device in such a way that severe vibrations are isolated and inhibited from being transmitted to the hull of the watercraft. Another purpose of the support structure is to prevent water from leaking into the watercraft through an opening provided to facilitate the transfer of torque through the hull from an engine to an impeller. In most applications, these two purposes work in conflict with each other. In other words, in order to effectively prevent leakage of water past the support structure, significant clamping forces are often used to compress a resilient portion of the support structure. However, the compression of a resilient support structure tends to facilitate the transfer of forces through the resilient member and therefore increases the transmission of vibration from the marine propulsion device to the hull of the watercraft. It would therefore be significantly beneficial if a means could be provided to adequately prevent water from leaking through or around the support structure while also providing a sufficiently soft and resilient mounting structure that is effective in isolating vibrations and inhibiting those vibrations from being transmitted from the marine propulsion device to the hull of the watercraft.

SUMMARY OF THE INVENTION

A marine propulsion device made in accordance with the present invention comprises an engine and a drive housing structure. A support wall of a marine vessel is provided and the engine is disposed on a first side of the support wall while the drive housing structure is disposed on a second side of the support wall. The support wall has an opening formed through its thickness and the opening is defined by a surrounding edge of the support wall. The present invention further comprises a plate that is disposed on the first side of the support wall and is attachable to the drive housing structure. The edge surrounding the opening through the hull is disposed between the drive housing structure and the plate. The present invention further comprises a compressible member that is shaped to conform to the opening and is disposed proximate the edge and between the plate and the drive housing structure. The compressible member has a generally U-shaped cross section with an open end shaped to receive the edge within the U-shaped cross section. The open end of the U-shaped cross section is defined by the distal ends of two arms of the U-shaped cross section of the compressible member. At least one of the distal ends of the two arms of the U-shaped compressible member is shaped to extend in a direction away from a second one of the distal ends of the two arms.

The engine can be attached to the plate and the invention can further comprise a spacer member disposed between a portion of the drive housing structure and the plate in order to define a minimum distance between the portion of the drive housing structure and the plate. The spacer can be an integral portion of the drive housing structure and the present invention can further comprise a gasket disposed between the plate and the portion of the drive housing structure which is additive to the spacer to define the minimum distance between the portion of the drive housing structure and the plate.

The compressible member of the present invention can be made of EPDM (ethylene propylene diene monomer) material. The compressible member, in a particularly preferred embodiment of the present invention, has a durometer hardness of between 45 and 55 and, preferably, a durometer hardness of approximately 50. The marine vessel can be a personal watercraft or a jet powered boat. The drive housing structure normally comprises an impeller which is supported for rotation about a central axis and connected in torque transmitting relation with the engine.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
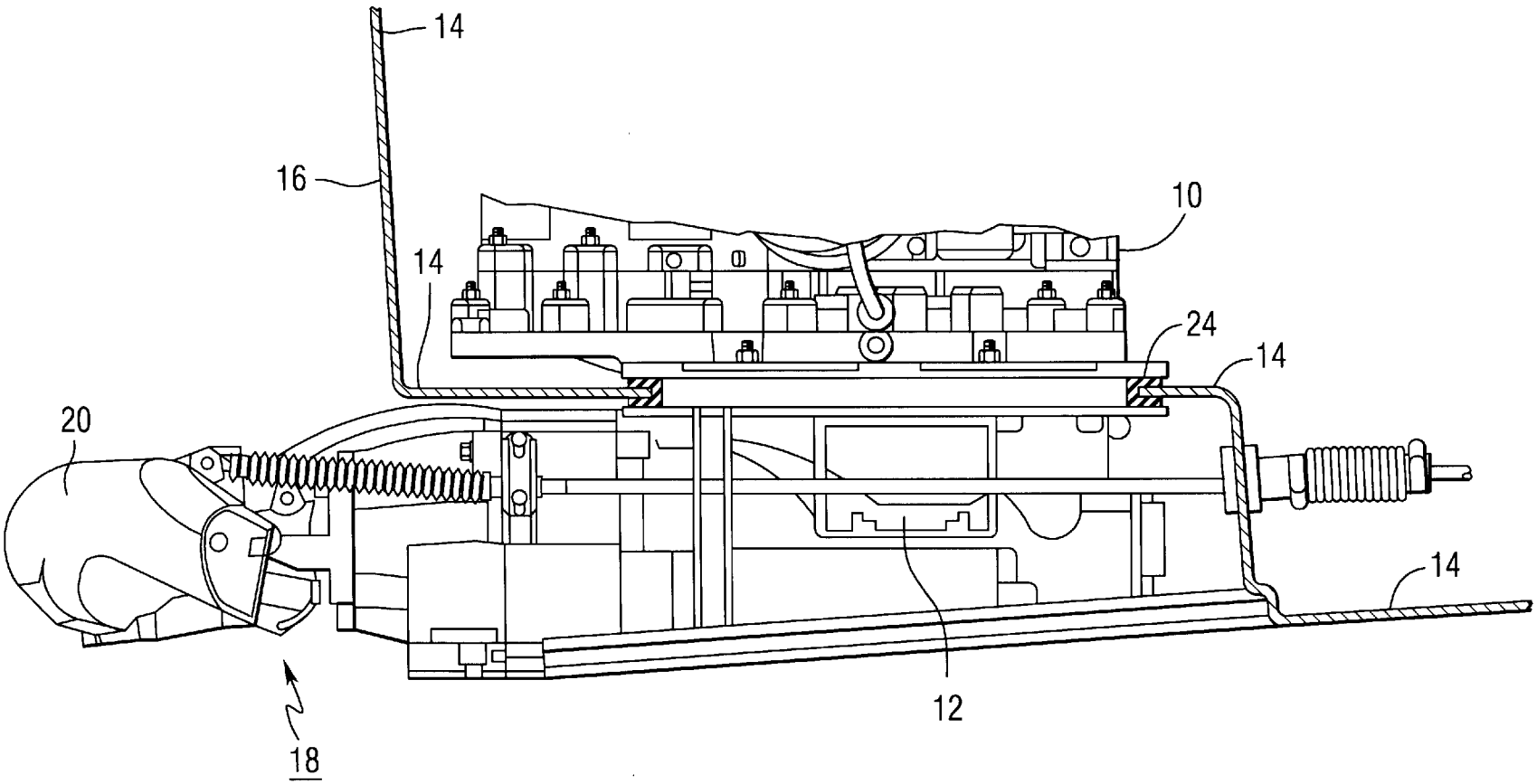
FIG. 1 PRIOR ART
FIG. 1 shows a cross section of a typical marine propulsion system imploring an impeller.

Throughout the description of the preferred embodiment of the present invention, like components will be identified by like reference numerals.

FIG. 1 is an exemplary illustration of the mounting location of a jet powered marine propulsion device. The marine propulsion device comprises an engine 10 that is attached to a jet pump 12. The hull of the marine vessel is identified by reference numeral 14 and a rear portion of the hull 14 is specifically identified by reference numeral 16. A nozzle structure 18 comprises a reversing bucket 20. The engine 10 is provided with a vertical driveshaft that is connected in torque transmitting relation with an impeller within the propulsion device 12 that is supported for rotation about a generally horizontal axis and which expels water in a direction toward the left in FIG. 1 and through the nozzle 18 to provide thrust for the marine vessel.

With continued reference to FIG. 1, it can be seen that an opening is formed through the hull 14 through which the engine 10 and the marine propulsion device 12 can extend and be attached to each other. An elastomeric device 24, or compressible member, surrounds the opening and provides support for the engine 10 and marine propulsion device 12.

In systems such as that represented in FIG. 1, vibrations can be transmitted from the engine 10 and the jet pump 12, or marine propulsion device, to the hull 14. These vibrations, if severe, can adversely affect the pleasure derived by the operator of the marine vessel. In addition, the transmitted vibrations can result in substantial noise emanating from the marine vessel.

With continued reference to FIG. 1, it should be understood that the elastomeric member 24 serves two purposes. First, it provides support for the engine 10 and the jet pump 12 and it also dampens vibrations emanating from the engine 10. It also serves to prevent water from leaking upward through the opening formed in the hull 14 and into the marine vessel.

Figure 2:
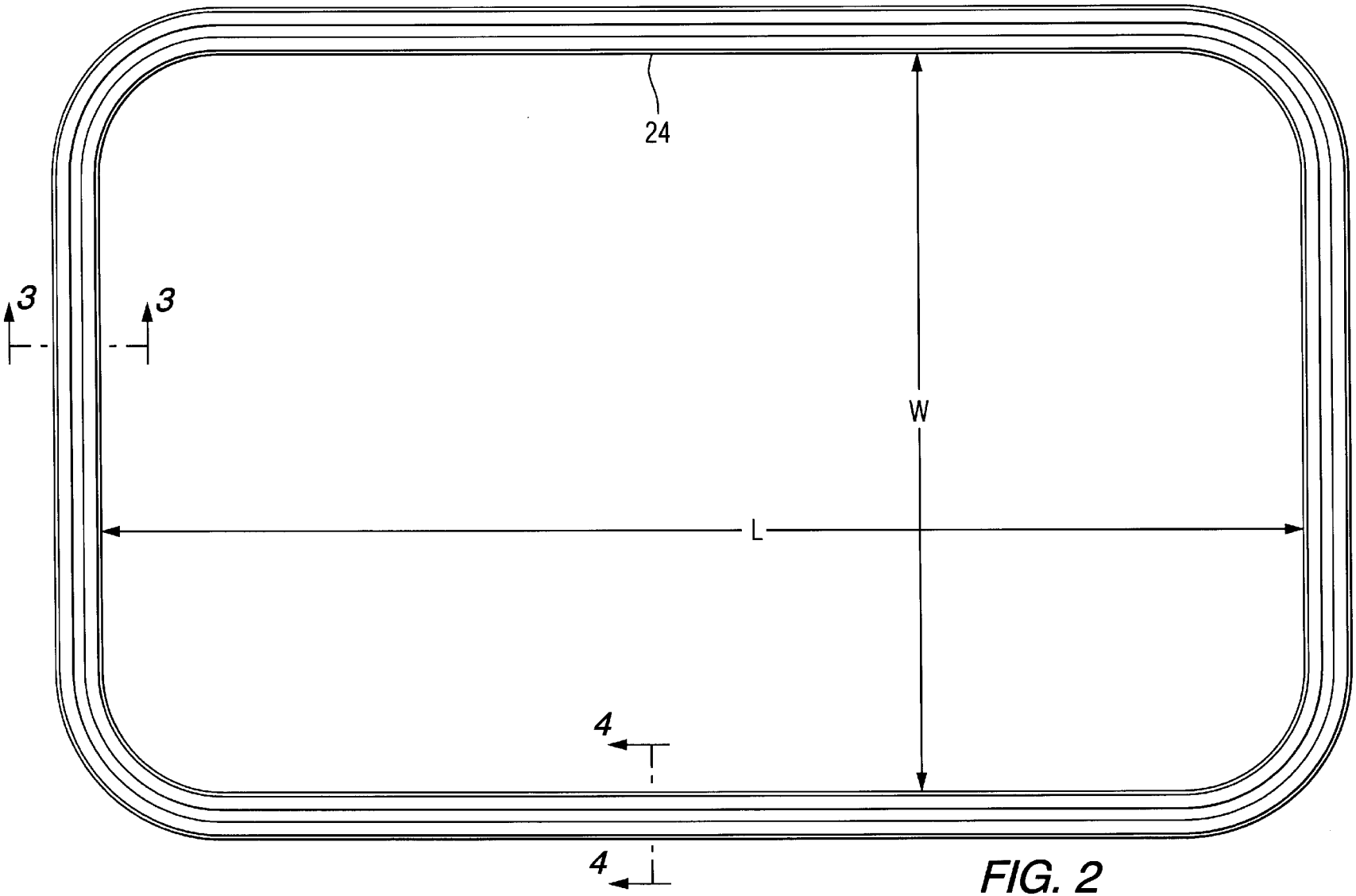
FIG. 2 is a top view of a compressible member made in accordance with the present invention.
Figure 3:
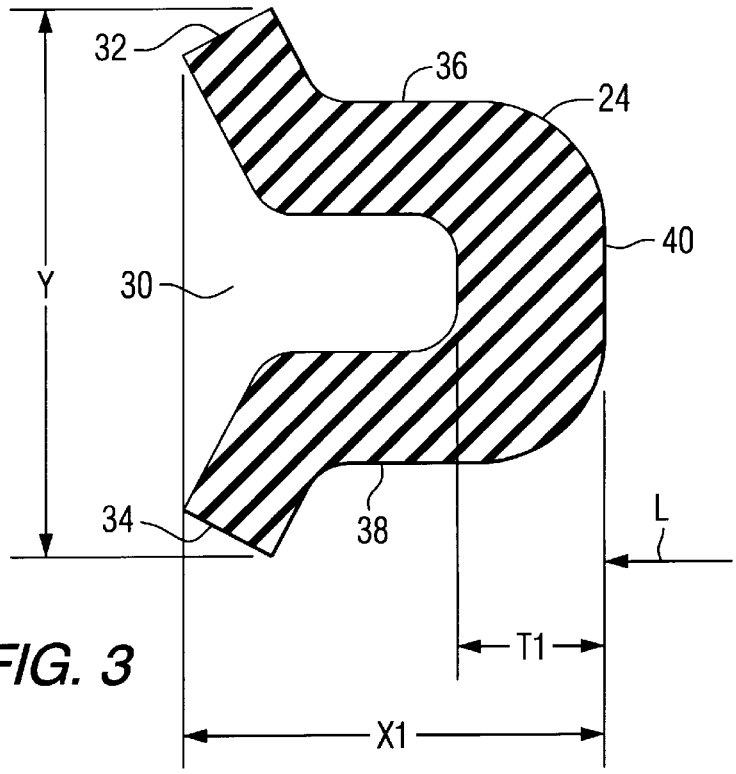
FIGS. 3 and 4 are section views of the compressible member shown in FIG. 2.
Figure 4:
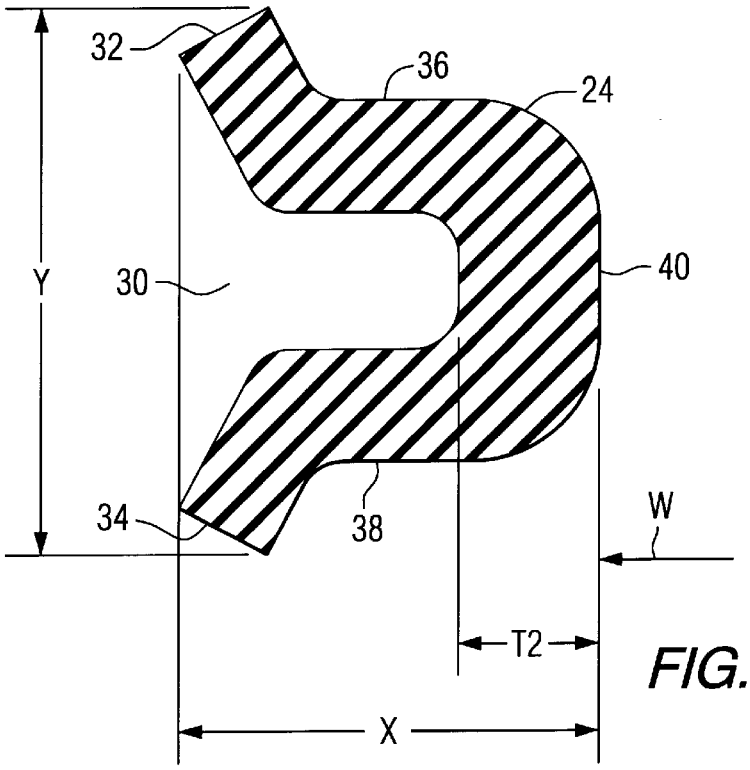

FIG. 2 shows a compressible member 24 made in accordance with the present invention. It is formed in a continuous, generally rectangular shape to conform to an edge that defines the opening formed through the hull 14 described above in conjunction with FIG. 1. FIGS. 3 and 4 are two section views showing the cross sectional shape of the compressible member.

With reference to FIGS. 2, 3, and 4, dimension L identifies the internal length dimension of the compressible member and dimension W defines the internal width dimension. FIG. 3 is a sectional view taken through the shorter ends. Although it should be clearly understood that the dimensions of the present invention are not limiting to its scope, it is helpful to understand the relative sizes of the various dimensions shown in FIGS. 2, 3, and 4. In one example of the present invention, dimension L is approximately 15.65 inches and dimension W is approximately 6.50 inches. In FIG. 3, dimension X is approximately 1.178 inches. It is possible, within the scope of the present invention, to vary the magnitude of the thickness at the closed end of the generally U-shaped compressible member. For example, at the two ends of the compressible member 24, thickness T1 can be approximately 0.395 inches while dimension T2 is approximately 0.270 inches. This difference in thickness is provided to accommodate more vibratory motion of the marine propulsion device 12 in the fore and aft direction than is necessary for the longer side portions of the compressible member 24.

With references to FIGS. 3 and 4, it can be seen that the compressible member is generally U-shaped in cross section with an open end 30 that is shaped to receive an edge of the opening, as will be described in greater detail below. The open end 30 of the generally U-shaped cross section of the compressible member 24 is defined by the distal ends, 32 and 34, of the two arms, 36 and 38. In FIGS. 3 and 4, both of the distal ends, 32 and 34, of the two arms, 36 and 38, are shaped to extend in a direction away from each other. However, it should be understood that alternative configurations of the present invention could incorporate only one distal end, 32 or 34, that extends away from the other arm, 36 or 38, to provide the sealing function of the present invention. In FIGS. 3 and 4, a closed end 40 of the generally U-shaped cross section is located at an opposite end from the open end 30.

Figure 5:
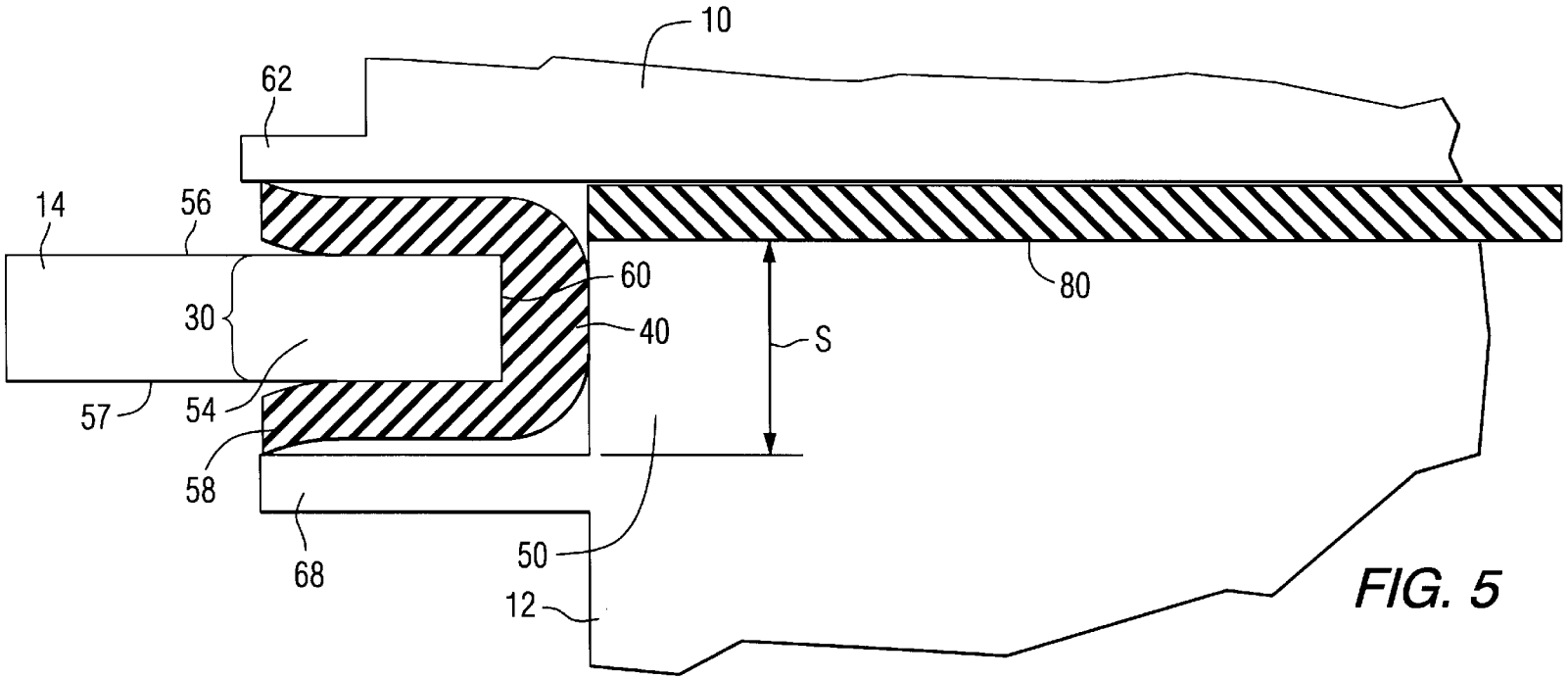
FIG. 5 is an enlarged view of a portion of the marine propulsion unit of FIG. 1, but made in accordance with the present invention.

FIG. 5 is an enlarged view of a portion of the structure of a watercraft in which an engine 10 and a marine propulsion device 12 are attached to each other through an opening formed through the hull 14 of the marine vessel. The marine propulsion device 12 comprises a drive housing structure 50 that supports an impeller that is rotatable about a generally horizontal centerline. A portion of the hull 14 provides a support wall 54 that supports both the engine 10 and the drive is housing structure 50. The engine 10 is disposed on a first side 56 of the support wall 54 and the drive housing structure 50 is supported on a second side 57 of the support wall 54. The support wall 54, as described above in conjunction with FIG. 1, has an opening formed through its thickness. In FIG. 5, it can be seen that the engine 10 and the drive housing structure 50 are connected to each other through this opening which is defined in shape by a surrounding edge 60.

With continued reference to FIG. 5, the plate 62 is disposed on the first side 56 of the support wall 54 and is attachable to the drive housing structure 50. The edge 60 is disposed between the drive housing structure 50 and the plate 62. More specifically, an extension 68 of the drive housing structure 50 and the plate 62 are provided to contain the edge 60 between them. The compressible member 58 is shaped to conform to the opening and is disposed proximate the edge 60 and between the plate 62 and the extension 68 of the drive housing structure 50. As shown in FIG. 5, the compressible member 58 is generally U-shaped in cross section with its open end 30 shaped to receive the edge 60 within it. As described above in conjunction with FIGS. 3 and 4, the open end 30 of the U-shaped cross section is defined by the distal ends of the two arms of the compressible member.

With continued reference to FIG. 5, it should be understood that a potential water leak path exists from below the support wall 54, and between the support wall 54 and the extension 68, toward the right and upward between the edge 60 and the upward extending portion of the drive housing structure 50 above the extension 58. The leakage path can then continue to the region between the support wall 54 and plate 62, turning toward the left in FIG. 5 to the region above the hull 14. This potential leakage path could allow water to leak into the watercraft from a position below the hull 14.

Figure 6:
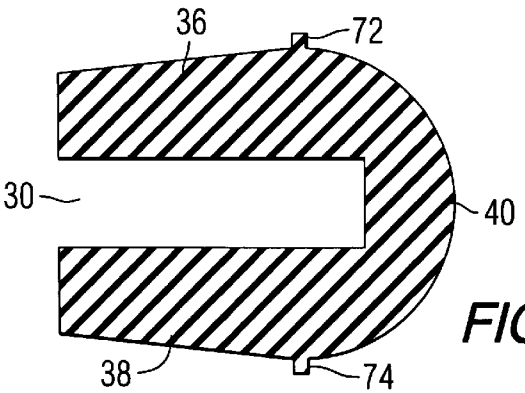
FIG. 6 is one alternative shape of a compressible member.

FIG. 6 shows one possible configuration of a compressible member.

However, it has been found that the shape of the cross section shown in FIG. 6 is not as effective in performing both of the two basic functions of a compressible member, as described above. The cross sectional shape shown in FIG. 6 comprises the two arms, 36 and 38, in combination with two protuberances, 72 and 74, which are compressed against the underside of plate 62 and the top surface of the extension 68 described above in conjunction with FIG. 5. The protuberances, 72 and 74, are intended to provide a liquid seal to prevent the path of water described above. However, it has been determined that the shape shown in FIG. 6 is not sufficiently effective for these purposes unless the compressible member is significantly compressed between the upper surface of extension 68 and the lower surface of plate 62. This significant compression, unfortunately, also increases the transmission of forces between the engine 10 and the hull 14. The cross sectional shape shown in FIGS. 3 and 4 has been proven to be significantly better than that shown in FIG. 6. It should also be understood that the shape of the compressible member 58 shown in FIG. 5 is a partially compressed shape due to the partial compression provided between the plate 62 and extension 68 when the engine 10 and its associated plate 62 is attached to the drive housing structure 50.

Figure 7B:
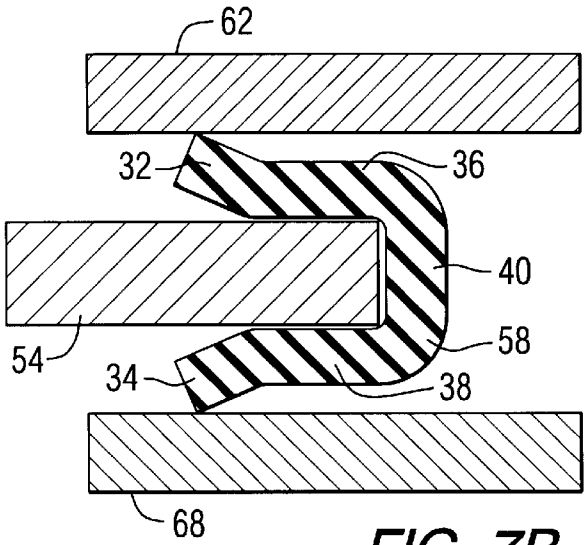
FIGS. 7A–7C show sequential steps in compressing the compressible member of the present invention.
Figure 7C:
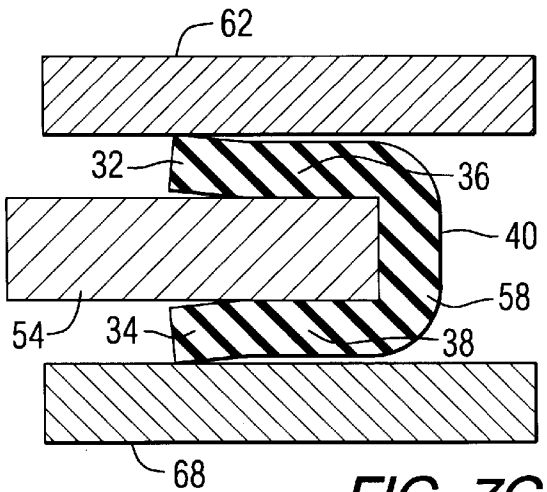
Figure 7A:
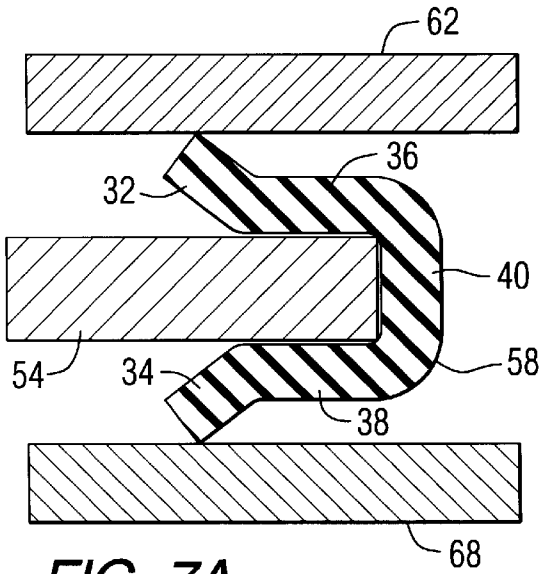

FIGS. 7A, 7B, and 7C show the progressive compression of the compressible member 58 as the plate 62 is moved toward the extension 68 of the drive housing structure 50 when these two components are attached together. FIG. 7A shows the compressible member 58 in an uncompressed state prior to the attachment of the plate 62 to extension 68 of the drive housing structure 50. As can be seen, the support wall 54 of the hull is disposed within the central portion of the U-shaped compressible member 58 and both distal ends, 32 and 34, of the two arms, 36 and 38, are extending away from each other and toward the plate 62 and extension 68, respectively.

FIG. 7B shows the relationship of the components as the plate 62 is partially moved toward the extension 68. As can be seen in FIG. 7B, the distal ends, 32 and 34, are being compressed toward each other and toward a general alignment with their associated arms, 36 and 38, respectively. However, it should be noted that the two arms, 36 and 38, are not being compressed between the plate 62 and the extension 68 of the drive housing structure 50. Sealing contact is being created between the distal ends, 32 and 34, and the underside of plate 62 and the top surface of the extension 68, respectively. As the movement of plate 62 toward extension 68 continues, as represented by FIG. 7C, the distal ends, 32 and 34, are compressed toward a general alignment with their associated arms of the U-shaped compressible member 58. However, because of the shape of the arms and the distal ends, the sealing force against the lower surface of plate 62 and upper surface of extension 68 occurs without having to significantly compress the arms, 36 and 38, of the compressible member 58. The sealing function of the compressible member 58 can be accomplished without significantly compressing the other portions of the compressible member 58. As a result, the overall structure of the compressible member 58 remains generally soft and not sufficiently rigid to transmit all of the forces created by the engine. In fact, in certain applications of the present invention, gaps may exist between the arms of the compressible member 58 and the two surfaces used to partially compress the compressible member between them and against the support wall 54.

With reference to FIG. 5, certain steps are taken to assure that the compressible member 58 is not significantly compressed between the lower surface of plate 62 and the upper surface of the extension 68 of the drive housing structure 50. It can be seen in FIG. 5, the position of extension 68 relative to the drive housing structure 50 defines a spacer member having a height identified by reference letter S. In the example described above, dimension S can be approximately 1.00 inch in magnitude. In addition, a gasket 80 is placed above the upper surface of the drive housing structure 50 between the drive housing structure and the lower surface of plate 62. The gasket can be approximately 0.050 inches in thickness. As a result, the spacer S and gasket 80 combine to define a height that limits the proximity of the lower surface of plate 62 to the upper surface of extension 68. It should be recognized that the gasket 80 is compressible, but the thickness of gasket 80 is selected so that the combined height of dimension S and the compressed thickness of gasket 80 are greater than the distance between the plate 62 and extension 68 required to significantly compress the compressible member 58. As a result, the plate 62 can not be tightened to a sufficient degree to compress the compressible member 58 between the plate 62 and extension 68 to a degree which would allow vibration and forces to be transmitted easily through the compressible member 58. It should be understood that when a compressible member is significantly compressed, it becomes much stiffer and is able to transmit forces much more efficiently than when it remains under a lesser degree of compression. The dimensions of the present invention are selected so that the compressible member 58 remains under only light compression even when the plate 62 is tightly attached and fastened to the drive housing structure 50 and its extension 68. Therefore, the compressible member 58 can not be compressed to the degree necessary to provide efficient transfer of forces through its thickness.

Figure 8:
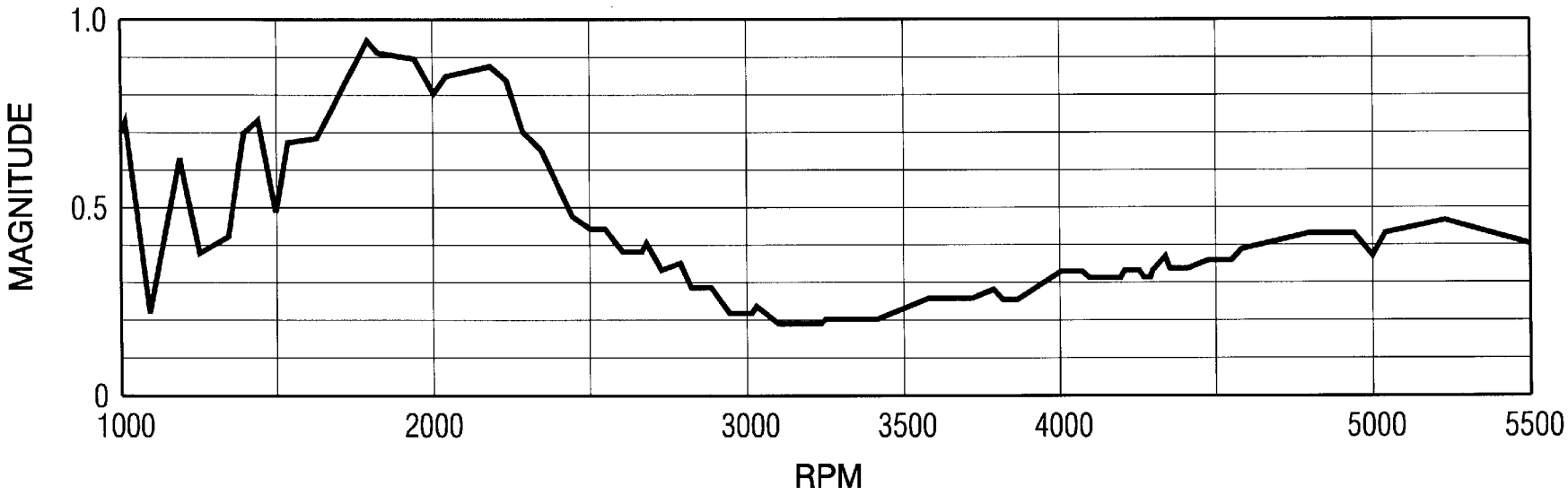
FIG. 8 shows the beneficial effect of the present invention in reducing the transmissibility of forces through the compressible member.

FIG. 8 shows the transmissibility of forces through the compressible member 58 from the engine 10 to the hull 14. The graphical representation in FIG. 8 shows the magnitude of the ratio between the magnitude of force provided by the engine 10 and the magnitude of force transferred to the hull 14 for a range of engine speeds. As can be seen, the transmissibility never exceeds 1.00 at any rotational speed of the engine, measured in RPM. The highest transmissibility occurs in the region of 1700 to 2200 RPM and is approximately equal to 0.9, whereas the transmissibility at operating speeds in excess of 3000 RPM are much lower. This improvement in transmissibility is a result of the fact that the compressible member 58 is not significantly compressed between the plate 62 and extension 68 because the dimensions of the compressible member 58 are selected in combination with the dimensions of the spacer dimension S and the thickness of gasket 80, as described above in conjunction with FIG. 5. This reduced compression of the compressible member is possible because the distal ends of the arms of the compressible member 58 extend away from each other to provide appropriate sealing between the compressible member 58 and the surfaces of both the plate 62 and extension 68 between which it is located.

Although the present invention has been described in considerable detail and illustrated to show one particular preferred embodiment, it should be understood that alternative embodiments are also within its scope.

We claim:

1. A marine propulsion device, comprising:

an engine;

a drive housing structure;

a support wall of a marine vessel, said engine being disposed on a first side of said support wall and said drive housing structure being disposed on a second side of said support wall, said support wall having an opening formed through a thickness of said support wall, said opening being defined by a surrounding edge of said support wall;

a plate disposed on said first side of said support wall, said plate being attachable to said drive housing structure, said edge being disposed between said drive housing structure and said plate; and a compressible member shaped to conform to said opening and disposed proximate said edge and between said plate and said drive housing structure, said compressible member having a generally U-shaped cross section with an open end shaped to receive said edge within said U-shaped cross section, said open end of said U-shaped cross section being defined by the distal ends of two arms of said U-shaped cross section of said compressible member, at least a first one of the distal ends of said two arms being shaped to extend in a direction away from its associated one of said two arms, one of said two arms of said U-shaped cross section remaining uncompressed either between said support wall of said marine vessel and said plate or between said support wall and said drive housing structure.

2. The device of claim 1, wherein:

said engine is attached to said plate.

3. The device of claim 1, further comprising:

a spacer member disposed between a portion of said drive housing structure and said plate to define a minimum distance between said portion of said drive housing structure and said plate.

4. The device of claim 3, wherein:

said spacer is integral with said drive housing structure.

5. The device of claim 4, further comprising:

a gasket disposed between said plate and said portion of said drive housing structure which is additive to said spacer to define said minimum distance between said portion of said drive housing structure and said plate.

6. The device of claim 1, wherein:

said compressible member is made of EPDM material.

7. The device of claim 1, wherein:

said first one of the distal ends of said two arms being shaped to extend in a direction away from a second one of said distal ends of said two arms.

8. The device of claim 1, wherein:

said marine vessel is a jet powered boat.

9. The device of claim 1, wherein:

said drive housing structure comprises an impeller which is supported for rotation about a central axis and connected in torque transmitting relation with said engine.

10. A marine propulsion device, comprising:

an engine;

a drive housing structure;

a support wall of a marine vessel, said engine being disposed on a first side of said support wall and said drive housing structure being disposed on a second side of said support wall, said support wall having an opening formed through a thickness of said support wall, said opening being defined by a surrounding edge of said support wall;

a plate disposed on said first side of said support wall, said plate being attachable to said drive housing structure, said edge being disposed between said drive housing structure and said plate, said engine being attached to said plate;

a compressible member shaped to conform to said opening and disposed proximate said edge and between said plate and said drive housing structure, said compressible member having a generally U-shaped cross section with an open end shaped to receive said edge within said U-shaped cross section, said open end of said U-shaped cross section being defined by the distal ends of two arms of said U-shaped cross section of said compressible member, at least a first one of the distal ends of said two arms being shaped to extend in a direction away from a second one of said distal ends of said two arms;

a spacer member disposed between a portion of said drive housing structure and said plate to define a minimum distance between said portion of said drive housing structure and said plate; and a gasket disposed between said plate and said portion of said drive housing structure which is additive to said spacer to define said minimum distance between said portion of said drive housing structure and said plate.

11. The device of claim 10, wherein:

said spacer is integral with said drive housing structure.

12. The device of claim 10, wherein:

said compressible member is made of EPDM material.

13. The device of claim 12, wherein:

said compressible member has a durometer hardness of between 45 and 55.

14. The device of claim 13, wherein:

said marine vessel is a personal watercraft.

15. The device of claim 13, wherein:

said marine vessel is a jet powered boat.

16. The device of claim 13, wherein:

said drive housing structure comprises an impeller which is supported for rotation about a central axis and connected in torque transmitting relation with said engine.

17. A marine propulsion device, comprising:

an engine;

a drive housing structure, said drive housing structure comprising an impeller which is supported for rotation about a central axis and connected in torque transmitting relation with said engine;

a support wall of a marine vessel, said engine being disposed on a first side of said support wall and said drive housing structure being disposed on a second side of said support wall, said support wall having an opening formed through a thickness of said support wall, said opening being defined by a surrounding edge of said support wall;

a plate disposed on said first side of said support wall, said plate being attachable to said drive housing structure, said edge being disposed between said drive housing structure and said plate, said engine being attached to said plate;

a compressible member shaped to conform to said opening and disposed proximate said edge and between said plate and said drive housing structure, said compressible member having a generally U-shaped cross section with an open end shaped to receive said edge within said U-shaped cross section, said open end of said U-shaped cross section being defined by the distal ends of two arms of said U-shaped cross section of said compressible member, at least a first one of the distal ends of said two arms being shaped to extend in a direction away from a second one of said distal ends of said two arms, said compressible member being made of EPDM material;

a spacer member disposed between a portion of said drive housing structure and said plate to define a minimum distance between said portion of said drive housing structure and said plate, said spacer being integral with said drive housing structure; and a gasket disposed between said plate and said portion of said drive housing structure which is additive to said spacer to define said minimum distance between said portion of said drive housing structure and said plate.

* * * * *